United States Patent [19]

Davis et al.

[11] 4,032,063

[45] June 28, 1977

[54] RETURNABLE SHIPPING BOX FOR FURNITURE

[75] Inventors: Philip J. Davis; M. Vincent Sanderford, both of Morganton, N.C.

[73] Assignee: Champion International Corporation, Stamford, Conn.

[22] Filed: Oct. 2, 1975

[21] Appl. No.: 618,919

[52] U.S. Cl. ..... 229/23 C; 206/326; 206/498

[51] Int. Cl.² ..... B65D 5/35; B65D 85/00

[58] Field of Search ..... 229/33, 23 C; 206/326

[56] References Cited

UNITED STATES PATENTS

| | | | |
|---|---|---|---|
| 1,152,359 | 8/1915 | Smith | 229/33 |
| 1,254,515 | 1/1918 | Leiman | 229/23 C |
| 1,420,001 | 6/1972 | Wagner | 229/33 |
| 2,373,701 | 4/1945 | Meredith | 229/33 |
| 2,709,547 | 5/1955 | Niedringhaus | 229/23 C |

*Primary Examiner*—William Price
*Assistant Examiner*—Douglas B. Farrow
*Attorney, Agent, or Firm*—Evelyn M. Sommer

[57] ABSTRACT

A returnable shipping box for large pieces of furniture arranged for convenient inspection of the furniture just before final packing at a shipping point and during the first stages of unpacking at a receiving station. The box includes a wooden base to which is attached a first foldable panel which folds into a position covering the front and sides of the furniture piece. A second foldable panel also attached to the base folds into a similar position covering the back and sides of the furniture. Both first and second panels are provided with sides and a top which nest together when the box is closed.

4 Claims, 10 Drawing Figures

RETURNABLE SHIPPING BOX FOR FURNITURE

BACKGROUND OF THE INVENTION

Shipping containers for large pieces of furniture have always been a source of expense since the containers must be well built and strong enough to protect the contents. At the receiving end the container is generally destroyed during unpacking and must be thrown away. This is especially true of containers that are difficult to unpack. This practice is additionally expensive when the receiver of the furniture discovers that some of the received pieces have been damaged and must be returned to the manufacturer. When this occurs, a makeshift carton is often used which may be the cause of further damage.

The present invention provides a returnable box for large heavy pieces of furniture. The box is designed so that it opens easily to reveal the entire piece so that inspection can be made before the piece is lifted from the carton base. The box includes a wooden base, and front and back foldable portions secured to the base and held together by sealing tapes. When the sealing tapes and portions of the bottom side panels of the foldable portions are cut and the two portions unfolded, the entire furniture piece is available for inspection. Then, if damage is discovered and a return is necessary the front and back panels are folded into place, securing tapes are applied and the box is ready for its return trip.

One of the features of the invention is the ease with which furniture pieces can be packed and unpacked in the furniture box.

Another feature of the invention is the facility of inspection before the complete removal of the piece from the box.

Still another feature of the object invention is the combination of the foldable carton portions and the wood skid base which achieves the advantages of: (1) providing the furniture piece with a solid base to sit on; (2) holding the returnable carton together at its base from which both the inner and outer foldable carton portions are hinged; and (3) providing support and added strength to the returnable carton.

Other features of the invention will be disclosed in the following description, taken in connection with the accompanying drawings.

DESCRIPTION OF THE PREFERRED EMBODIMENT

Figure 1:
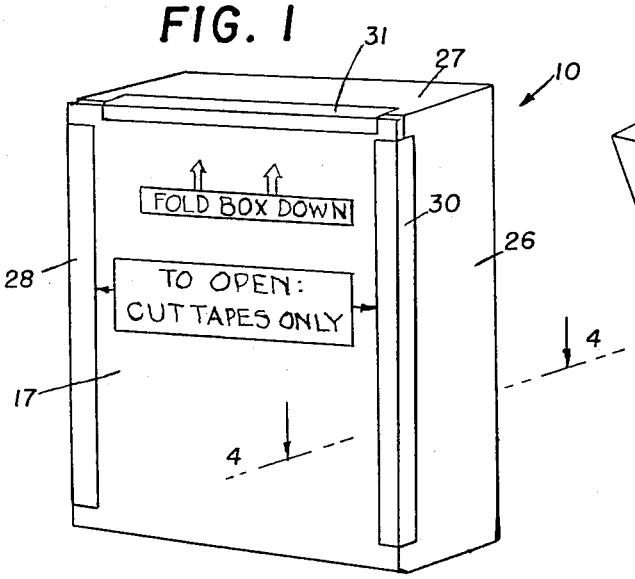
FIG. 1 is a perspective view of the subject returnable shipping box when closed, ready for shipping.
Figure 2:
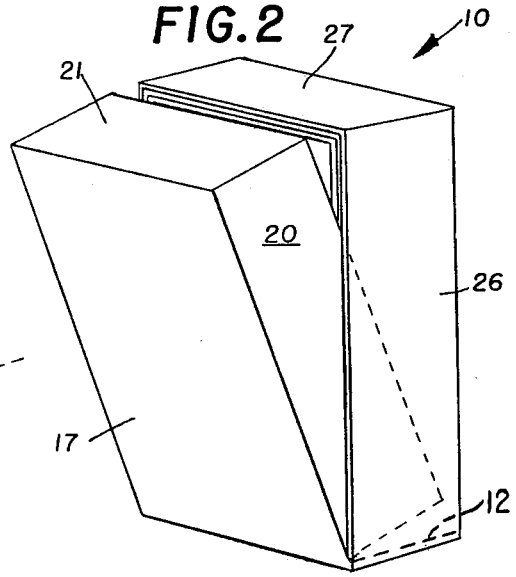
FIG. 2 is a view similar to FIG. 1 but showing the returnable shipping box cut along dotted line 12 and one of the foldable portions partly disengaged from the other box components.
Figure 3:
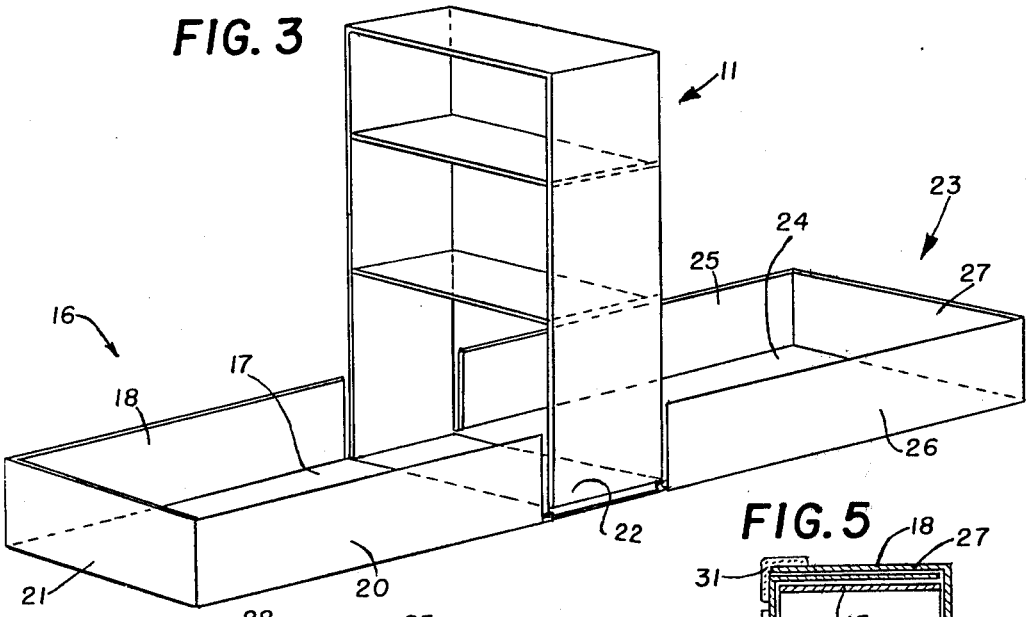
FIG. 3 is a perspective view of the box when the front and back portions are unfolded from the piece of furniture.
Figure 4:
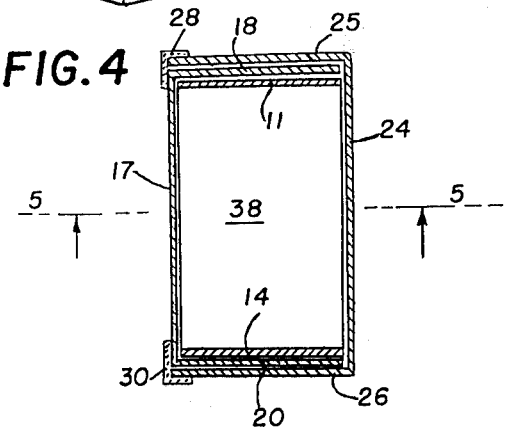
FIG. 4 is a cross sectional view of the box shown in FIG. 1 and is taken along line 4—4 of that figure.
Figure 5:
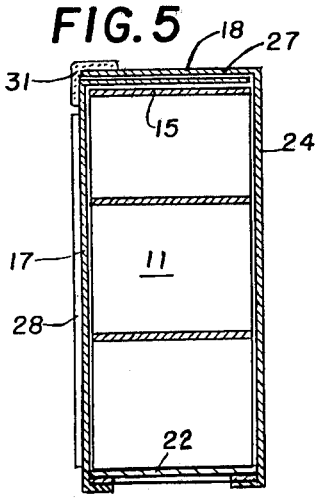
FIG. 5 is a cross sectional view of the box shown in FIG. 4 and is taken along line 5—5 of that figure.

The returnable shipping box 10 as shown in FIGs. 1, 2, and 3 includes a base 22 and two foldable portions 16 and 23. The outer foldable portion 23 also has a top 27 and two sides 25 and 26, as well as base flaps 33. The inner foldable portion 16 is provided with a top 21, two sides 18 and 20, and base flaps 36. In FIG. 3 a piece of furniture 11 ( a bookcase) is shown positioned on the wooden base 22 of the box. The upper portions of the box are made of corrugated paper board, and the base 22 may be made from a single piece of plywood, reinforced by battens.

Figure 6:
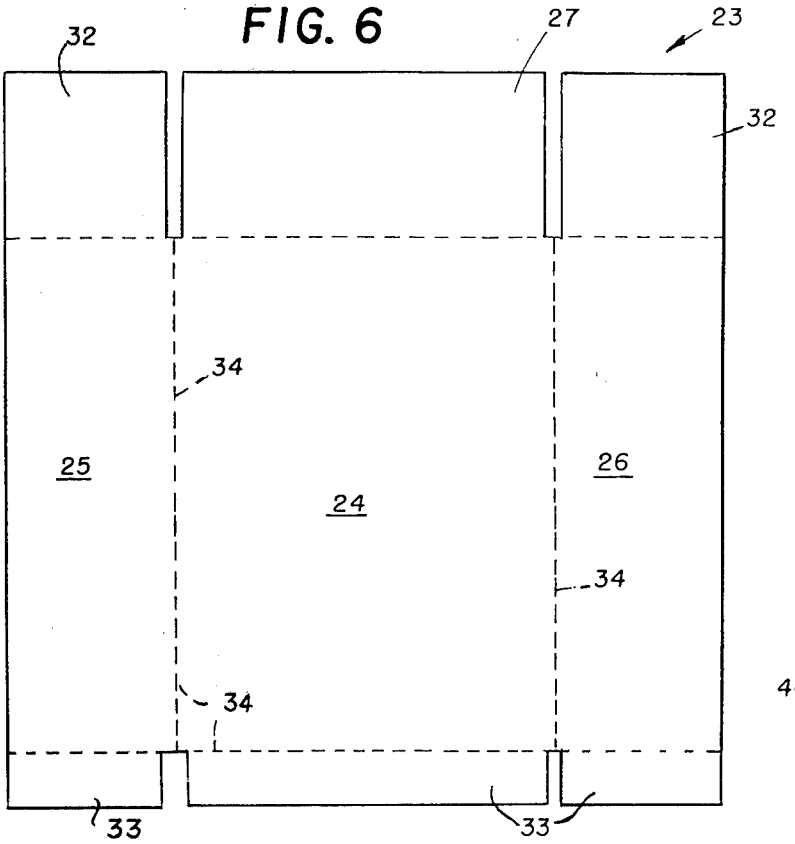
FIG. 6 is a plan view of the development of the outer foldable portion, prior to folding.

FIG. 6 shows the development of the outer foldable portion 23 including a central piece 24, a bordered by two foldable side pieces 25 and 26, and base flaps 33. An upper top piece 27 is connected to the central piece 24 and each side piece supports a flap 32. At the bottom, three flaps 33 are provided for gluing or stapling to the wooden base 22. All the foldable pieces and flaps are integral with the central piece 24 but are defined by scored lines for easy folding, as shown in FIG. 6 by dotted lines 34.

Figure 9:
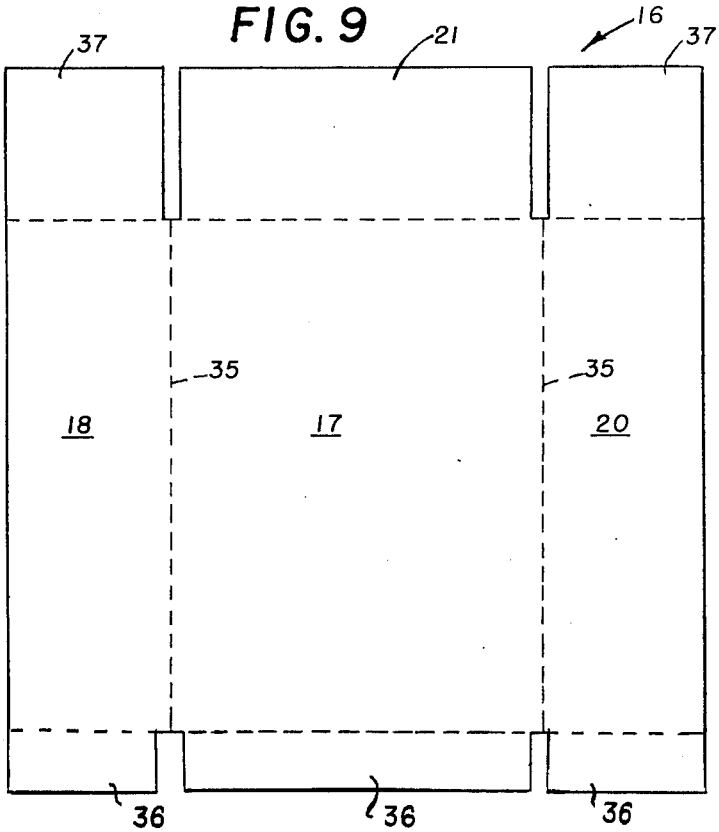
FIG. 9 is a plan view of the development of the inner foldable portion, prior to the folding.

The development for the inner foldable portion 16 is shown in FIG. 9 and is similar to the development shown in FIG. 6 but is slightly smaller. The inner development 16 includes a central piece 17, foldable side pieces 18, 20, an upper top piece 21, and base flaps 36 which are formed at the bottom of portion 16 for attachment to the wooden base 22. The side pieces 18, 20 each supports an upper flap 37. The foldable pieces are scored along score lines 35.

Figure 7:
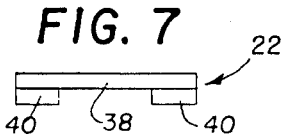
FIG. 7 is a side view of the wooden base.
Figure 8:
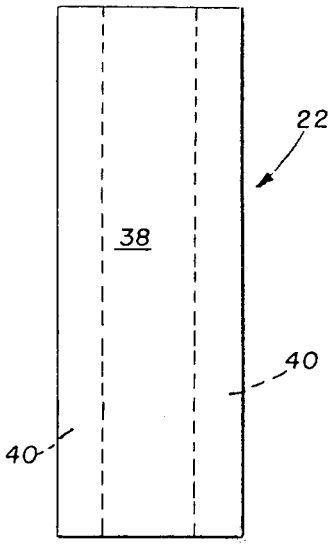
FIG. 8 is a top view of the preferred form of the base, including a one-piece panel board top and two reinforcing lower battens.
Figure 10:
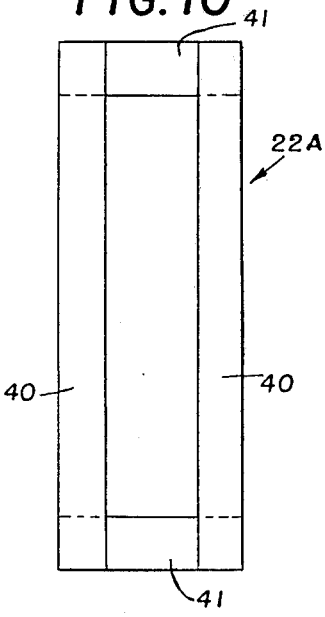
FIG. 10 is a top view of an alternate from of the base, including four battens.

The preferred form of the base 22 is shown in FIGS. 7 and 8 where a flat wooden panel board 38 is cut to the inside dimensions of the box and is reinforced by two battens 40. An alternate form of wooden base 22A shown in FIG. 10 and includes the two battens 40 connected to two cross pieces 41.

The box is assembled by folding the respective side panels as well as top panel and top flaps about the respective score lines 34 and 35 and securing the two foldable portions 16 and 23 together by means of tape strips 28, 30 and 31, as shown in FIG. 1. The assembled carton is then drawn down over the furniture piece 11 and the carton, along with the furniture piece is turned bottom side up. At this point, the wooden skid frame or base 22 is placed inside the carton, and the carton flap portions 33 and 36 are folded in and stapled to the wooden skid frame 22. The assembled returnable shipping box in then inverted and is in condition for shipment to its destination. The use of the skid base frame 22 has the advantage of providing the furniture with a solid base to sit on, holding the carton together at its base from which both inner and outer portions are hinged; and provide support and added strength to the shipping carton.

When the shipping carton arrives at its receiving station, the three sealing tapes 28, 30, and 31 are slit with a knife, and then the shipping carton is cut along dotted lines 12 on opposite sides of the shipping carton so that both foldable portions 16 and 23 may be unfolded to completely expose the furniture piece 13. After inspection, the furniture piece may be removed, but, if inspection shows a damaged piece, it is merely necessary for the receiver of the furniture piece to fold the two foldable portions 16 and 23 to their initial positions, and reapply tapes 28, 30 and 31. In addition, additional tapes are provided to cover the slit portions 12. It is noted that when the carton is originally cut along the dotted lines 12, both the outer and inner foldable portions are cut. Using the skid frame base 22 as a back support for the cutting insures no damage to the furniture piece 11 resulting from the knife.

From the above description of the returnable shipping box of the subject invention, and its operation, it will be obvious that a novel returnable shipping container has been developed which can be used many times for shipping furniture at a greatly reduced cost.

The embodiments of the invention in which an exclusive property or privilege is claimed are defined as follows:

1. A returnable shipping box for furniture comprising:

a. a wooden planar base having a top and bottom surface and a pair of opposed side edges for supporting a piece of furniture on said top surface;

b. a first foldable portion comprising a plurality of base flaps attached to the bottom surface about said side edges of said base, and a front panel for engaging the front portion of a furniture piece, said front panel joined by side and top members which slidably engage the sides and top of the furniture piece when folded to form a closed box;

c. a second foldable portion including a plurality of base flaps attached to the bottom surface about said side edges of said base and a back panel for engaging the back portion of the furniture piece, said back panel joined by side and top members which slidably engage the sides and top of the first foldable portion when folded to form a closed box, the base laps of said first and second foldable portions defining a marginal area around said base when said base flaps are attached to said base, said marginal area including a portion of the base flaps of said first and second foldable portions overlying the opposed side edges of said base whereby said marginal area can be slit with the side edges of said base serving as a backing member for a slitting device so that said first and second portions can be pivoted relative to each other to an open position to expose the furniture piece within said box and can be repivoted to a closed position to reseal said box; and d. plural tapes holding the first and second foldable portions in their closed positions.

2. A shipping box as defined in claim 1 wherein said foldable portions are made of wooden panel boards.

3. A shipping box as defined in claim 1 wherein said foldable portions are made of corrugated kraft paper board.

4. A shipping box as defined in claim 1 wherein said first and second foldable portions unfold to form a substantially flat coextensive plane with the wooden base for convenient inspection of furniture carried by the box.

* * * * *